United States Patent [19]

Diaz

[11] Patent Number: 4,777,332

[45] Date of Patent: Oct. 11, 1988

[54] APPARATUS FOR CONTROLLING THE CONNECTION OF AN ELECTRICAL MODULE TO AN ELECTRICAL RECEPTACLE

[75] Inventor: Randall J. Diaz, Gilroy, Calif.

[73] Assignee: Tandem Computers Incorporated, Cupertino, Calif.

[21] Appl. No.: 65,233

[22] Filed: Jun. 22, 1987

[51] Int. Cl.[4] ..... H01H 9/20

[52] U.S. Cl. ..... 200/50 A; 200/5 A; 235/145 R; 466/479; 466/485; 466/488

[58] Field of Search ..... 200/43.16, 43.18, 43.19, 200/43.21, 43.22, 42.01, 42.02, 43.01, 43.02, 50 R, 50 A, 50 AA, 50 B, 50 C; 361/343, 339

[56] References Cited

U.S. PATENT DOCUMENTS

| | | | |
|---|---|---|---|
| 2,300,102 | 10/1942 | Christensen | 200/50 A |
| 3,801,757 | 4/1974 | Carissimi et al. | 200/50 B |
| 3,919,507 | 11/1975 | Middleton, Jr. | 200/50 A |
| 4,071,722 | 1/1978 | Hart | 200/50 A |
| 4,563,552 | 1/1986 | Fushimoto | 200/50 A X |
| 4,596,907 | 6/1986 | La Greco et al. | 200/50 R |

*Primary Examiner*—J. R. Scott

*Attorney, Agent, or Firm*—Townsend and Townsend

[57] ABSTRACT

An apparatus for controlling the connection of an electrical module to an electrical receptacle. The module is provided with a power switch having a movable switch activator for inhibiting a flow of current to the electrical module when the switch activator is in a first position and for flowing a current to the electrical module when the switch activator is in a second position. The switch activator has a side portion which extends from a surface of the module when the switch activator is in the second position, but which does not extend from the surface of the module when the switch activator is in the first position. A lock member is disposed on a surface of the module and is slidable to a retracted position when the switch activator is in the first position. The lock member extends from the module and abuts against the side portion of the switch activator when the switch activator is in the second position. When the lock member is in the retracted position, the module may be readily connnected to or disconnected from the receptacle. When the lock member is extended, the module is prevented from being positioned in the prescribed orientation for connecting to the electrical receptacle, or, when the module and receptacle are already connected, the lock member extends into a bounded opening in the surface of the receptacle and the module cannot be disconnected from the receptacle.

20 Claims, 2 Drawing Sheets

APPARATUS FOR CONTROLLING THE CONNECTION OF AN ELECTRICAL MODULE TO AN ELECTRICAL RECEPTACLE

BACKGROUND OF THE INVENTION

The present invention relates to locking assemblies for electrical control devices and, more particularly, to an apparatus for controlling the connection of an electrical module to an electrical receptacle.

DESCRIPTION OF THE RELEVANT ART

Many computer and other electronic systems are constructed so that individual electronic modules of the system may be selectively inserted and removed from the cabinet which houses them. Such modular construction greatly facilitates repair and replacement of the individual modules, but it creates a number of drawbacks. For example, if a power supply is either inserted or removed from an electrical receptacle within the cabinet while the power supply is turned on, voltage spikes may occur. These voltage spikes can be very detrimental to the components of the system. Accordingly, there exists a need for a mechanism which ensures that power is not being supplied to a module upon either insertion or removal of that module. On the other hand, the mechanism must not be so difficult to operate that the purpose of constructing modular components is thwarted. Furthermore, the mechanism must be capable of being used within crowded cabinets having very little space available for extraneous hardware. Finally, the mechanism must be simple and must not require specialized hardware which increases the complexity and cost of the system.

SUMMARY OF THE INVENTION

The present invention is directed to an apparatus for controlling the connection of an electrical module to an electrical receptacle wherein the module power switch must be in an off position before the module may be inserted into or removed from a system cabinet. The apparatus of the present invention is simple, compact, and readily adaptable to cabinets having very little extra space.

In one embodiment of the present invention, the module is provided with a power switch having a movable switch activator for inhibiting the flow of current to the electrical module when the switch activator is in a first position and for flowing a current to the electrical module when the switch activator is in a second position. The switch activator has a side portion which extends from a surface of the module when the switch activator is in the second position, but which does not extend from the surface of the module when the switch activator is in the first position. The module is slidingly disposed on a surface of the receptacle and is positioned in a prescribed orientation relative to the receptacle surface when the module is connected to the receptacle.

A lock member is disposed on the surface of the module and is slidable to a retracted position when the switch activator is in the first position. The lock member extends from the module and abuts against a side portion of the switch activator when the switch activator is in the second position. When the lock member is in the retracted position, the module may be inserted into the system cabinet and oriented in the prescribed position relative to the electrical receptacle for connecting thereto. If already connected, the module and receptacle may be disconnected and the module may be removed from the cabinet. On the other hand, when the lock member is extended, the module is prevented from being positioned in the prescribed orientation for connecting to the electrical receptacle. When the module and receptacle are already connected and the switch activator is in the on position, the lock member extends into a bounded opening in the surface of the receptacle, and the module cannot be disconnected from the receptacle.

These and other advantages of the invention will become apparent to those skilled in the art upon a reading of the following detailed description of the invention, which should be taken in conjunction with the accompanying drawings.

DETAILED DESCRIPTION OF THE PREFERRED EMBODIMENTS

Figure 1:
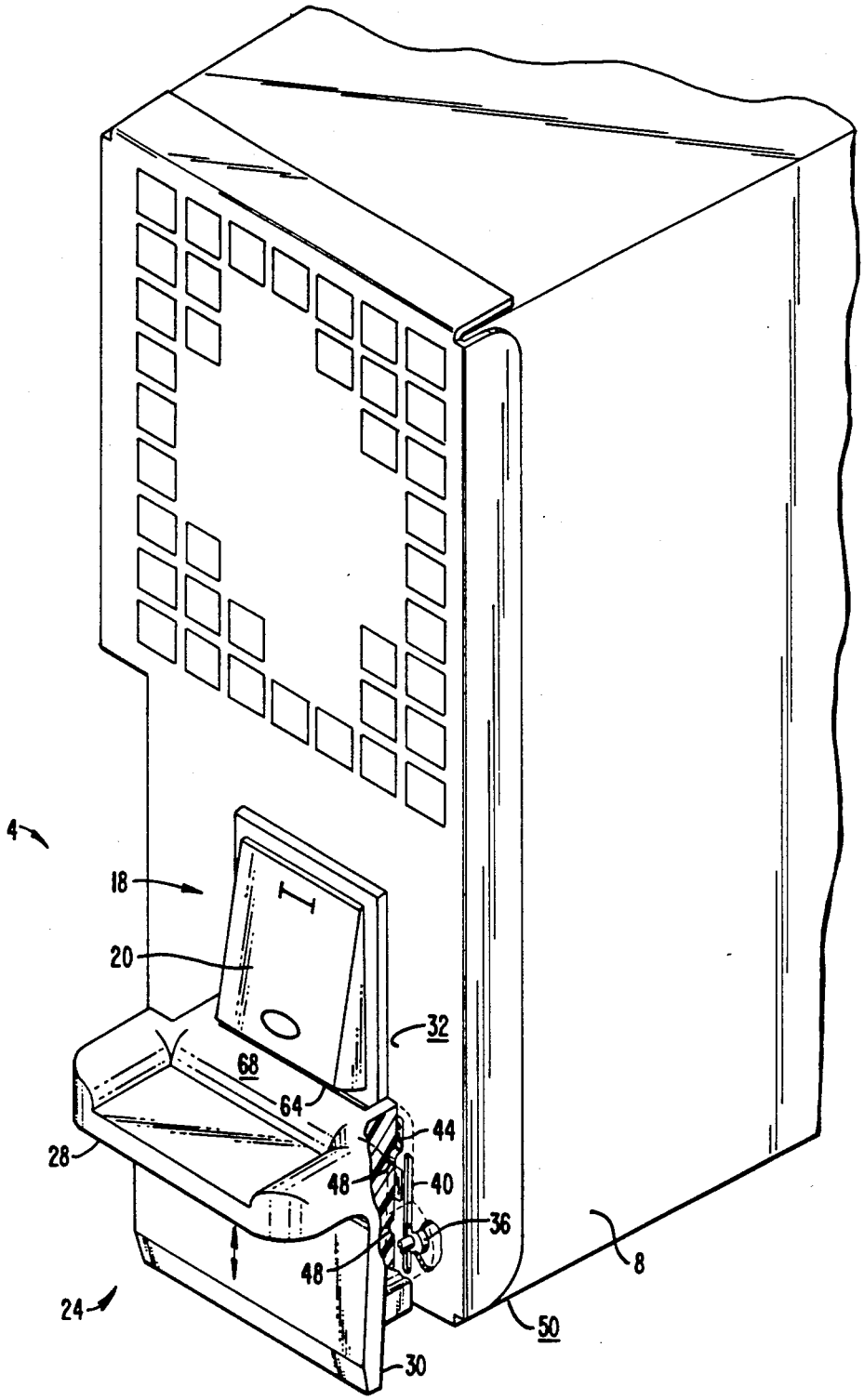
FIG. 1 is a perspective view of an electrical module according to the present invention.
Figure 2:
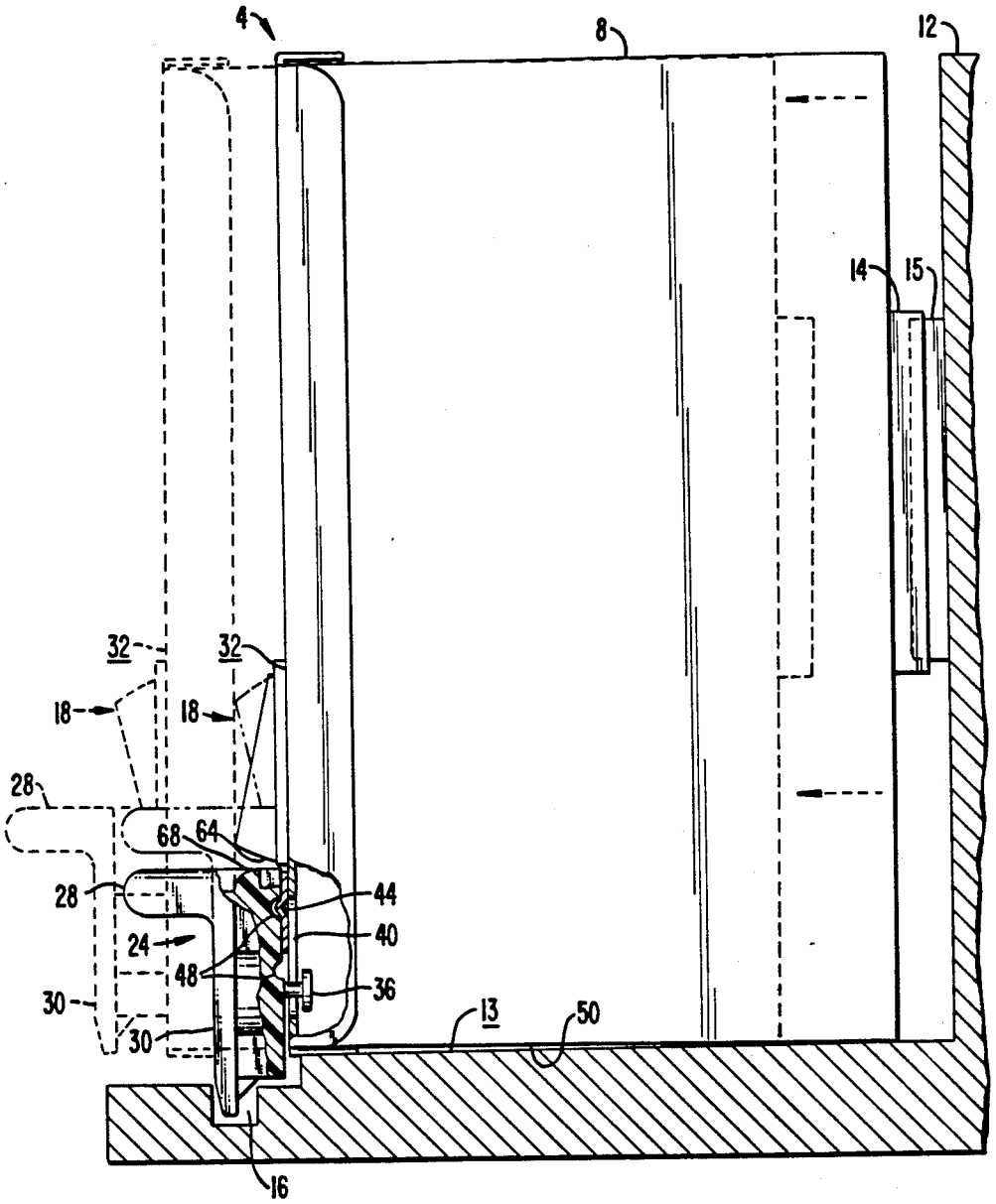
FIG. 2 is a side view of the module of FIG. 1 mounted to an electrical receptacle.

FIGS. 1 and 2 are perspective and side views, respectively, of an apparatus 4, according to the present invention, for controlling the connection of an electrical module 8 to an electrical receptacle 12. Module 8 is adapted to slide on a surface 13 of receptacle 12 and assumes a prescribed orientation relative to surface 13 when connected to receptacle 12, as shown in FIG. 2. Module 8 connects to receptacle 12 through well known electrical connectors 14 and 15, respectively. Surface 13 of electrical receptacle 12 includes a bounded opening 16 for reasons discussed below.

As shown in FIG. 1, module 8 includes a power switch 18 having a switch activator 20. Switch activator 18 is moved from a first "off" position, shown in phantom in FIG. 2, for inhibiting a current flow to module 8, and to a second "on" position, shown in FIG. 1, for flowing a current to module 8. Module 8 further includes a lock mechanism 24 for preventing connection of module 8 to or removal of module 8 from receptacle 12 when switch activator 20 is in a prescribed position, e.g., in the on position.

Lock mechanism 24 includes a handle member 28 and a lock member 30 slidingly affixed to a surface 32 of module 8 by a pair of lugs 36 extending through a corresponding pair of slots 40 in surface 32. Affixed to surface 32 is a leaf spring 44 for engaging a pair of grooves 48 embedded in lock member 30 and for providing a detente when lock mechanism 24 is in an upper or lower position. Lock member 30 extends below a bottom surface 50 of module 8 when lock mechanism 24 is in the lower position, and lock member 30 generally aligns with bottom surface 50 when lock mechanism 24 is in the upper position.

Switch activator 20 includes a side portion 64 which extends from surface 32 of module 8 when switch 18 is in the on position. When switch 16 is in this position, side 64 of switch activator 20 abuts against a portion 68 of lock member 30 and maintains lock member 30 in its extended position. On the other hand, when switch 16 is in the off position, side 64 of switch activator 20 does not abut against portion 68, and portion 68 of lock member 30 may be slid past side 64 for allowing lock mechanism 24 to assume its upper, retracted position.

In operation, switch activator 20 of switch 18 is placed in the off position, and lock mechanism 24 is slid into the upper position, whereby lock member 30 aligns with bottom 50 of module 8. Module 8 then is slid along surface 13 of receptacle 12 until module 8 assumes the proper orientation relative to surface 13 and electrical connector 14 mates with electrical connector 15. Lock mechanism 24 then may be slid into the lower position so that lock member 30 extends into bounded opening 16, and side 64 of switch activator 20 is exposed. Switch activator 20 then may be moved into the on position and current may flow through module 8 accordingly. As long as switch activator 20 is in the on position. Lock member 30 thus is confined within bounded opening 16 and module 8 may not be disconnected from receptacle 12.

When module 8 is to be disconnected from receptacle 12, switch activator 20 is moved into the off position. In this position, lock mechanism 24 may be readily slid into the upper position with lock member 30 disposed over side 64 of switch activator 20. When in the upper position, lock member 30 aligns with bottom surface 50 of module 8, free of bounded opening 16, and module 8 may be readily disconnected from receptacle 12.

If an attempt is made to reconnect module 8 to receptacle 12, switch activator 20 must be in the off position and lock mechanism 24 must be in the upper position, or else lock member 30 will interfere with surface 13 and module 8 may not be positioned in the prescribed orientation relative to receptacle 12 for connection thereto.

As a result of the foregoing, module 8 may not be connected to or disconnected from receptacle 12 unless switch activator 20 is in the off position. By constructing lock mechanism 24 so that it performs both the retaining function for module 8 and the locking function to prevent activation of switch 16, and by using switch 18 for performing part of the locking function, the number of hardware components is minimized and the device takes up minimal space.

While the above is a complete description of a preferred embodiment of the present invention, various modifications are obvious to those skilled in the art. For example, switch 16 may comprise separate buttons which are individually depressed and which alternately extend from surface 32, depending on whether the circuit is to be placed in the on or off mode. Alternatively, switch 16 may control a separate pin, which moves in and out of a corresponding aperture within lock mechanism 24 for maintaining lock mechanism 24 in place. Consequently, the scope of the invention should not be limited except as properly described in the claims.

I claim:

1. A module for connecting to a receptacle comprising:

a first surface;

a second surface disposed generally perpendicularly to the first surface;

a rocker switch affixed to the second surface, the rocker switch having a rocker switch activator for inhibiting a current flow through the switch when the switch activator as in a first position and for allowing a current flow through the switch when the switch activator is in a second position, a portion of the switch activator extending from the second surface when the switch activator is in the second position, and the portion of the switch activator being generally aligned with the second surface when the switch activator is in the first position;

a lock member slidingly disposed on the second surface in close proximity to the switch activator;

the lock member being slidable from an extended position, wherein a first portion of the lock member extends from the first surface of the module, to a retracted position wherein the first position of the lock member is generally aligned with the first surface of the module;

the lock member having a second portion which is disposed over the portion of the switch activator when the lock member is in the retracted position and the switch activator is in the first position; and the second portion of the lock member abutting against the portion of the switch activator when the switch activator is in the second position and the lock member is in the extended position for preventing the lock member from being moved into the retracted position.

2. An apparatus for controlling the electrical connection of a module to a receptacle comprising:

a receptacle having a first surface and a second surface disposed generally perpendicularly to the first surface;

a first electrical connector disposed on the first surface of the receptacle;

a module having a first surface and a second surface disposed generally perpendicularly to the first surface;

a second electrical connector disposed on the first surface of the module for slidingly connecting with the first electrical connector;

wherein the first surface of the module and the receptacle and the second surfaces of the module and receptacle are disposed in close proximity to each other when the first and second electrical connectors are connected, and the second surfaces of the module and receptacle are oriented and move parallel to each other when the first and second electrical connectors are to be connected and disconnected for each other;

a switch having a movable switch activator for inhibiting a current flow from the first electrical connector to the second electrical connector when the switch activator is in a first position and for allowing a current flow from the first electrical connector to the second electrical connector when the switch activator is in a second position;

lock means, disposed on the module in close proximity to the switch activator, for preventing connection of the first and second electrical connectors by preventing the second surfaces of the module and receptacle from moving parallel to each other when the switch activator is in the second position and the first electrical connector is in close proximity to, but not connected to, the second electrical connector.

3. An apparatus for controlling the electrical connection of a module to a receptacle comprising:

a receptacle having a first surface and a second surface disposed generally perpendicularly to the first surface;

a first electrical connector disposed on the first surface of the receptacle;

a module having a first surface and a second surface disposed generally perpendicularly to the first surface;

a second electrical connector disposed on the first surface of the module for slidingly connecting with the first electrical connector;

wherein the first surfaces of the module and the receptacle and the second surfaces of the module and receptacle are disposed in close proximity to each other when the first and second electrical connectors are connected, and the second surfaces of the module and receptacle are oriented and move parallel to each other when the first and second electrical connectors are to be connected and disconnected from each other;

a switch having a movable switch activator for inhibiting a current flow from the first electrical connector to the second electrical connector when the switch activator is in a first position and for allowing a current flow from the first electrical connector to the second electrical connector when the switch activator is in a second position;

lock means, disposed on the module in close proximity to the switch activator, for preventing disconnection of the first and second electrical connectors by preventing the second surfaces of the module and receptacle from moving parallel to each other when the switch activator is in the second position.

4. The apparatus according to claim 3 wherein the lock means prevents connection of the module to the receptacle when the switch activator is in the second position by preventing the second surfaces of the module and receptacle from moving parallel to each other when the first electrical connector is in close proximity to, but not connected to, the receptacle.

5. The apparatus according to claim 4 wherein the lock means includes a lock member which immovably extends from the second surface of the module when the switch activator is in the second position.

6. The apparatus according to claim 5 wherein the lock member abuts against the second surface of the receptacle and prevents the second surfaces of the module and receptacle from being oriented parallel to each other when the switch activator is in the second position and the first electrical connector is in close proximity to, but not connected to, the second electrical connector.

7. The apparatus according to claim 5 further comprising means, disposed on the second surface of the receptacle, for confining the lock member when the switch activator is in the second position and the module is connected to the receptacle, so that the second surfaces of the module and receptacle are prevented from moving parallel to each other.

8. The apparatus according to claim 6 wherein the lock member extends into a bounded opening in the second surface of the receptacle and is confined therein when the switch activator is in the second position and the module is connected to the receptacle, so that the second surfaces of the module and receptacle are prevented from moving parallel to each other.

9. The apparatus according to claim 8 further comprising means for permitting the lock member to move relative to the module when the switch activator is in the first position.

10. The apparatus according to claim 8 wherein the locking means includes means for permitting the lock member to move to a retracted position relative to the second surface of the module when the switch activator is in the first position, so that the second surfaces of the module and receptacle may be oriented and moved parallel to each other.

11. The apparatus according to claim 5 wherein the switch activator includes a portion which abuts against the lock member when the switch activator is in the second position for maintaining the lock member in an extended position.

12. The apparatus according to claim 11 wherein the portion of the switch activator does not abut against the lock member when the switch activator is in the first position, and the locking means includes means for permitting the lock member to move to a retreated position relative to the second surface of the module when the switch activator is in the first position.

13. The apparatus according to claim 12 wherein the switch activator comprises a rocker switch disposed in close proximity to the lock member.

14. The apparatus according to claim 13 wherein the rocker switch and the lock member are mounted on a third surface of the module, the third surface being oriented generally perpendicularly to the second surface of the module, and wherein a portion of the rocker switch extends from the third surface when the rocker switch is in the second position.

15. The apparatus according to claim 14 wherein the portion of the rocker switch is in a generally retracted position relative to the third surface of the module when the rocker switch is in the first position.

16. The apparatus according to claim 15 wherein the lock member is slidably mounted on the third surface of the module in close proximity to the portion of the rocker switch so that the lock member may be moved past the portion of the rocker switch when the rocker switch is in the first position.

17. The apparatus according to claim 16 wherein the lock member is disposed over the portion of the rocker switch when the rocker switch is in the first position and the lock member is in the retracted position.

18. The apparatus according to claim 17 wherein the rocker switch is confined to the first position by the lock member when the lock member is in the retracted position.

19. The apparatus according to claim 18 wherein the portion of the rocker switch prevents the lock member from moving to the retracted position when the rocker switch is in the second position.

20. A module for connecting to a receptacle, the receptacle being of the type having a first surface with a first electrical connector affixed thereto and a second surface disposed generally perpendicularly to the first surface, the second surface having a bounded opening therein, the module comprising:

a first surface;

a second surface disposed generally perpendicularly to the first surface;

a third surface disposed generally perpendicularly to the second surface;

a second electrical connector affixed to the first surface of the module for slidingly connecting to the first electrical connector;

wherein the first surfaces of the module and the receptacle and the second surfaces of the module and receptacle are disposed in close proximity to each other when the first and second electrical connectors are connected, and the second surfaces of the module and receptacle are oriented and move parallel to each other when the first and second electrical connectors are to be connected and disconnected from each other;

a rocker switch affixed to the third surface, the rocker switch having a rocking switch activator for inhibiting a current flow from the first electrical connector to the second electrical connector when the switch activator is in a first position and for allowing a current flow from the first electrical connector to the second electrical connector when the switch activator is in a second position, a portion of the switch activator extending from the third surface when the switch activator is in the second position, and the portion of the switch activator being generally aligned with the third surface when the switch activator is in the first position;

a lock member slidingly disposed on the third surface in close proximity to the switch activator;

the lock member being moveable from an extended position, wherein a first portion of the lock member extends from the second surface of the module, to a retracted position wherein the first portion of the lock member is generally aligned with the second surface of the module;

the lock member having a second portion which is moved over the portion of the switch activator when the lock member is moved to the retracted position and the switch activator is in the first position;

the second portion of the lock member being located for abutting against the portion of the switch activator when the switch activator is in the second position and the lock member is in the extended position for preventing the lock member from being moved into the retracted position;

so that, when the module is connected to the receptacle and the switch activator is in the second position, the first portion of the lock member extends into the opening in the second surface of the receptacle and is bounded thereby for preventing the second surfaces of the module and receptacle from moving parallel to each other and thereby preventing disconnection of the first and second electrical connectors; and so that, when the module is disconnected from the receptacle and the switch activator is in the second position, the first portion of the lock member abuts against the second surface of the receptacle when the first electrical connector is in close proximity to the second electrical connector and prevents the second surfaces of the module and receptacle from moving parallel to each other thereby preventing connection of the first and second electrical connectors.

* * * * *